US010370138B2

(12) United States Patent
Asbjoernsen et al.

(10) Patent No.: US 10,370,138 B2
(45) Date of Patent: Aug. 6, 2019

(54) CONTAINER WITH REMOVABLE INSERT

(71) Applicant: Aquafigure AS, Bru (NO)

(72) Inventors: Kristian Noraas Asbjoernsen, Bru (NO); Joakim Noraas Asbjoernsen, Bru (NO); Aleksander Noraas Asbjoernsen, Bru (NO); Orjan Tunge Asbjornsen, Bru (NO)

(73) Assignee: Aquafigure AS, Bru (NO)

( * ) Notice: Subject to any disclaimer, the term of this patent is extended or adjusted under 35 U.S.C. 154(b) by 0 days.

(21) Appl. No.: 16/079,323

(22) PCT Filed: Feb. 20, 2017

(86) PCT No.: PCT/EP2017/053805

§ 371 (c)(1),
(2) Date: Aug. 23, 2018

(87) PCT Pub. No.: WO2017/144417

PCT Pub. Date: Aug. 31, 2017

(65) Prior Publication Data

US 2019/0071207 A1 Mar. 7, 2019

Related U.S. Application Data

(60) Provisional application No. 62/300,243, filed on Feb. 26, 2016.

(51) Int. Cl.
*B65D 1/02* (2006.01)
*B65D 23/14* (2006.01)
(Continued)

(52) U.S. Cl.
CPC ..... *B65D 1/02* (2013.01); *B65D 23/14* (2013.01); *G09F 3/0294* (2013.01); *G09F 3/04* (2013.01);
(Continued)

(58) Field of Classification Search
CPC .... B65D 1/02; B65D 23/14; G09F 2003/0273
See application file for complete search history.

(56) References Cited

U.S. PATENT DOCUMENTS 1,725,199 A 8/1929 Kuhn et al.
2,000,419 A * 5/1935 Sarber ..... A47G 19/24 206/14
(Continued)

FOREIGN PATENT DOCUMENTS

GB 2349631 11/2000
WO WO 2017/144417 8/2017

OTHER PUBLICATIONS

ISA/EP, International Search Report for PCT/EP2017/053805 (dated Mar. 21, 2017).
(Continued)

*Primary Examiner* — Gary C Hoge
(74) *Attorney, Agent, or Firm* — Fish & Richardson P.C.

(57) ABSTRACT

A container (140) having a mouth (142), a bottom (144) and a self-supporting display foil (100). The foil may include a protrusion (162) at a first end (160) and a second end (180). The first end is positioned within the mouth of the container, and the second end is positioned at the bottom of the container. The foil being sufficiently flexible so as to be reversibly deformed, wherein the deformed foil may be placed into or removed from the container through the mouth.

16 Claims, 15 Drawing Sheets

(51) Int. Cl.
*G09F 3/00* (2006.01)
*G09F 3/04* (2006.01)
*G09F 3/02* (2006.01)

(52) U.S. Cl.
CPC ..... *G09F 2003/0223* (2013.01); *G09F 2003/0251* (2013.01); *G09F 2003/0273* (2013.01)

(56) References Cited

U.S. PATENT DOCUMENTS 2,356,399 A 8/1944 Hansen
4,582,498 A * 4/1986 Tamada ..... B65D 23/14 446/160
4,842,140 A * 6/1989 Mesnard ..... B65D 1/02 206/457
5,242,066 A * 9/1993 Kelsey ..... B29C 49/0078 215/379
5,462,278 A * 10/1995 Valyi ..... A63F 9/001 206/579
5,588,550 A * 12/1996 Meyer ..... B65D 1/04 215/6
5,788,794 A * 8/1998 Valyi ..... B29C 65/4835 156/245
5,879,496 A * 3/1999 Bright ..... B29C 61/00 156/446
5,937,554 A * 8/1999 Haugk ..... B05B 11/0005 40/310
6,022,437 A * 2/2000 White ..... A47G 33/08 156/212
6,042,022 A 3/2000 Rogozinski et al.
6,233,856 B1 5/2001 Haugk et al.
6,399,167 B1 * 6/2002 Lewis, Jr. ..... A47G 33/08 428/11
8,484,870 B1 * 7/2013 Burns ..... G09F 3/00 40/310
2002/0029501 A1 * 3/2002 Braun ..... G09F 3/0292 40/310
2005/0229450 A1 * 10/2005 Larsen ..... A47G 19/2227 40/310
2006/0210717 A1 * 9/2006 Chang ..... B05D 1/02 427/421.1

OTHER PUBLICATIONS

ISA/EP International Preliminary Report on Patentability for PCT/EP2017/053805, dated Aug. 28, 2018 (7 pages).

* cited by examiner

CONTAINER WITH REMOVABLE INSERT

CROSS-REFERENCE TO RELATED APPLICATIONS

This application claims benefit of U.S. provisional Patent Application Ser. No. 62/300,243 filed on Feb. 26, 2016, the contents of which are incorporated in their entirety herein by reference.

FIELD OF THE INVENTION

The invention relates to the field of containers, in particular, to a container with a self-supporting insert which may be reversibly placed into or removed from the container.

BACKGROUND OF THE INVENTION

Liquids (e.g., beverages, perfumes, and cleaning solutions) are often packaged in transparent containers bearing one or more physical labels which may have informative and/or decorative indicia. Labels are generally affixed (e.g., glued) to, printed on, embossed on, engraved in, or embedded within the surface of a container, generally during manufacturing. See, e.g., U.S. Pat. Nos. 1,725,199, 2,356,399, 6,022,437, and 8,484,870. Labels may alternatively be attached to a structure within a container, e.g., a pump (as in, e.g., a soap dispenser). See, e.g., U.S. Pat. No. 6,233,856. These labels are generally not self-supporting and are not easily (or at all) separable from the container they are attached to (or part of, in the case of embossed, engraved, or embedded labels). As a result, such labels generally do not possess or add any independent value of their own—that is, they do not possess any independent value apart from their role as an intermediary in associating the indicia they include with the container they are attached to.

Thus, it is desirable to provide a container with indicia provided on a self-supporting insert within the container to enhance, e.g., aesthetics and/or marketing potential, and/or provide additional options for conveying information (including, e.g., advertising or security-related indicia). The insert can be provided, e.g., as a collectible/novelty item which can be removed from the container before, during, or after the consumption or removal of other content (e.g., one or more liquids) (if any) present in the container. In the beverage field, considering that sugared drinks are linked to various health issues (e.g., obesity, diabetes, etc.), a packaging design that would enhance the attractiveness of bottled water, for example, could thus indirectly provide a health benefit for the population in general, and for children in particular.

SUMMARY OF THE INVENTION

A container having a mouth and a bottom, with a self-supporting insert (e.g., a content display foil) which may be reversibly placed into or removed from the container.

In an aspect, the foil may be placed in the container with the first end positioned at, near or within the mouth of the container and the second end positioned at or near the bottom of the container. In an aspect, the first end may comprise a protrusion or tab extending through and/or over the mouth of the container.

In an aspect, the foil may be sufficiently flexible so as to be reversibly deformed and placed into or removed from the container through the mouth (e.g., rolled up into a roll of diameter less than a diameter of the mouth of the container).

In an aspect, the foil may have a first end comprising a protrusion and a second end comprising an indentation.

In an aspect, the foil may have a length defined by a first axis connecting the first end and the second end, and a width defined by a second axis perpendicular to the first axis.

In an aspect, the protrusion at the first end and/or the indentation at the second end may occur in the direction defined by the first axis.

In an aspect, the protrusion at the first end may have a width less than the width of the remainder of the foil. For example, the width of the protrusion may be less than the diameter of the mouth of the container. In an aspect, the width of the foil may increase in a continuous fashion between the protrusion and the remainder of the foil.

In an aspect, the protrusion at the first end may comprise one or more indentations occurring in the direction defined by the first axis.

In an aspect, the foil may be reversibly placed into or removed from a container having a mouth and a bottom where the bottom of the container protrudes into the container. In an aspect, the indentation at the second end may be capable of accommodating (and/or positioned so as to accommodate) the protrusion at the bottom of the container.

In an aspect, the foil may have one or more protrusions or indentations occurring in the direction defined by the second axis between the first end and the second end. In an aspect, the one or more protrusions or indentations may be capable of accommodating (and/or positioned so as to accommodate) protrusions or indentations, respectively, in a surface of the container.

In an aspect, the foil may include one or more indicia, e.g., one or more graphics or other visual content. For example, a graphic may be affixed (e.g., glued) to, printed on, embossed on, engraved in, or embedded within the foil, to provide a content display foil.

In an aspect, the graphic may be reversibly or irreversibly detachable from the foil. For example, the portion of the foil comprising the graphic may be reversibly or irreversibly detachable from the remainder of the foil.

In an aspect, the container and the foil may each be fully opaque, fully transparent, translucent and/or semi-transparent. In an aspect, the container and the foil may each have any combination of fully opaque, fully transparent, translucent and/or semi-transparent portions.

In an aspect, two or more foils may be combined into a single self-supporting insert which may be reversibly placed into or removed from the container. For example, two foils may be joined at an angle (e.g., a perpendicular angle) at their respective centerlines.

In an aspect, the container and/or the foil may be manufactured using one or more materials such that the container and/or the foil possess a refractive index essentially the same as (e.g., identical to) the refractive index of one or more liquids placed within (or capable of being placed within) the container.

Certain implementations may have particular advantages. For example, a foil with a protrusion at the first end positioned within the mouth of a container and an indentation at the second end positioned to accommodate the protrusion at the bottom of the container may be particularly stable in terms of maintaining position of the foil within the container. The foil may be stable in the presence of any liquid(s) and may be stable even without any additional container design features to provide support.

For example, a container and foil each possessing a refractive index essentially the same as the refractive index of a liquid placed within the container may achieve a visual effect wherein the foil (except for indicia, if any) appears to disappear from view.

BRIEF DESCRIPTION OF THE DRAWINGS

The above and other objects, features, aspects, and advantages will be more clearly understood from the following drawings. In the drawings, like reference numerals refer to like parts throughout the various figures unless otherwise specified.

DETAILED DESCRIPTION

Figure 1:
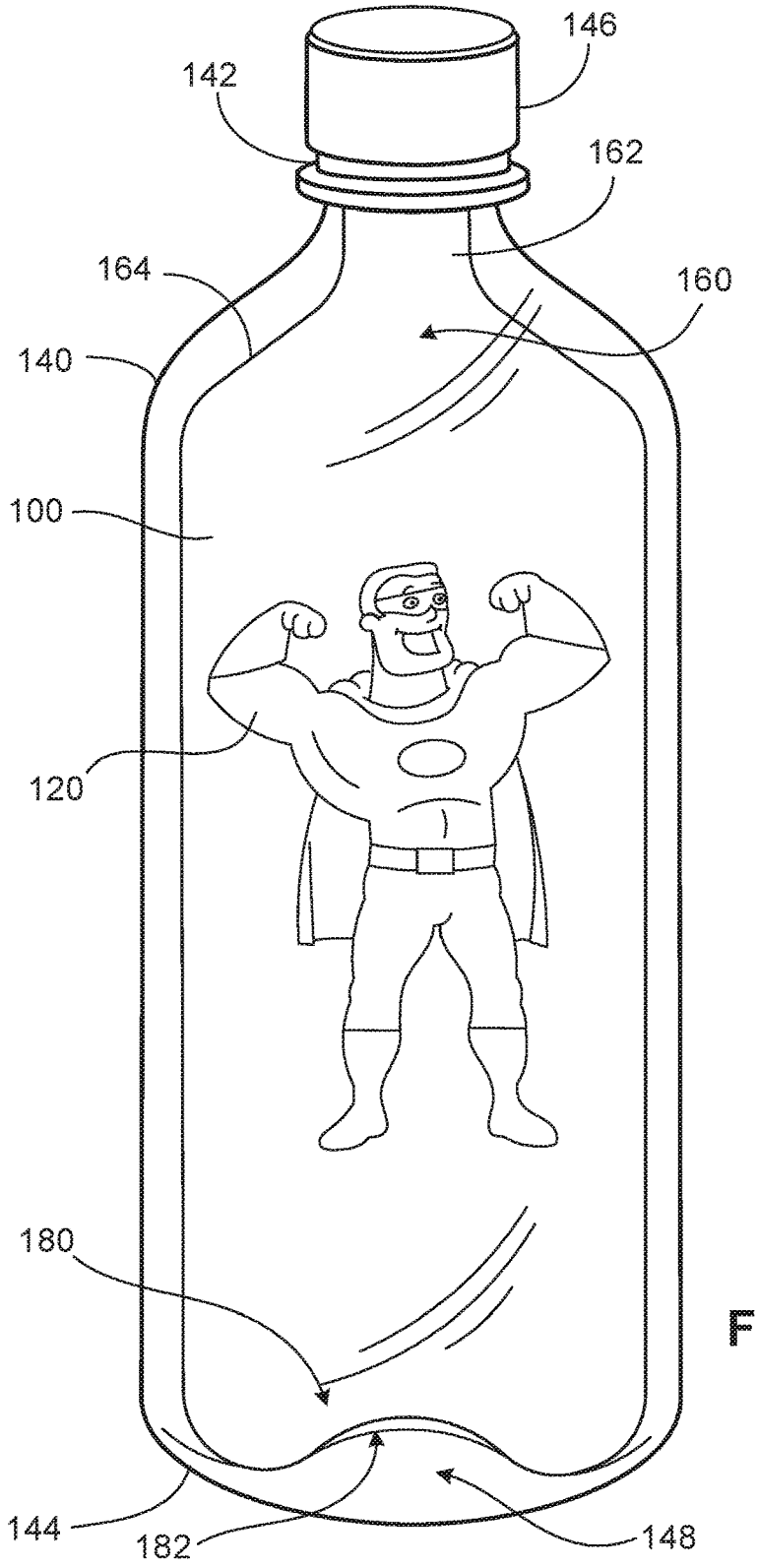
FIG. 1 is a perspective front view of a container including an insert according to an embodiment of the present invention.

With reference to FIG. 1, there is shown a foil 100 including a graphic 120 placed within a container 140 having a mouth 142, a bottom 144, a cap 146, and an indentation in the bottom 148. The foil 100 includes a protrusion 162 at a first end 160 and an indentation 182 at a second end 180. The first end 160 is positioned within the mouth of the container 142, and the second end is positioned such that indentation 182 in foil 180 accommodates the indentation (or "push-up") 148 in the bottom of the container 140. The width of the foil is less than the diameter of the container and decreases in a continuous fashion at shoulder 164 between protrusion 162 at the first end and the remainder of the foil.

Foil 100 may be a self-supporting insert (e.g., a content display foil), optionally including one or more graphics. It may be reversibly placed into or removed from a container having a mouth and a bottom (and, optionally, a cap or lid covering the mouth). A graphic (if applicable) may be affixed (e.g., glued) to, printed on, embossed on, engraved in, or embedded within the foil. In an embodiment, a first image of the graphic may be printed on a translucent or transparent foil, and then a solid color silhouette of the image, for example in white, is printed onto the first image, coincident with the first image. Then a second image of the graphic is printed over the silhouette. This approach makes the printed graphic less translucent and thus can increase the visual contrast of the printed material. The foil may be placed in the container with the first end positioned at, near or within the mouth of the container and the second end positioned at the bottom of the container. The foil may be sufficiently flexible so as to be reversibly deformed and placed into or removed from the container through the mouth (e.g., rolled up into a roll of diameter less than a diameter of the mouth of the container). The foil may have a length defined by a first axis connecting the first end and the second end, and a width defined by a second axis perpendicular to the first axis. The protrusion at the first end and/or the indentation at the second end may occur in the direction defined by the first axis.

Foil 100 may be reversibly placed into or removed from a container having a mouth and a bottom where the bottom of the container protrudes into the container. The indentation at the second end may be capable of accommodating (and/or positioned so as to accommodate) the protrusion at the bottom of the container. The present description is directed to generally cylindrical containers such a beverage bottles. However, the present invention may be employed with containers of various shapes such as rectangular (square-shaped) and other polygonal and irregular shapes capable of accommodating the content display foil described herein.

Figure 2:
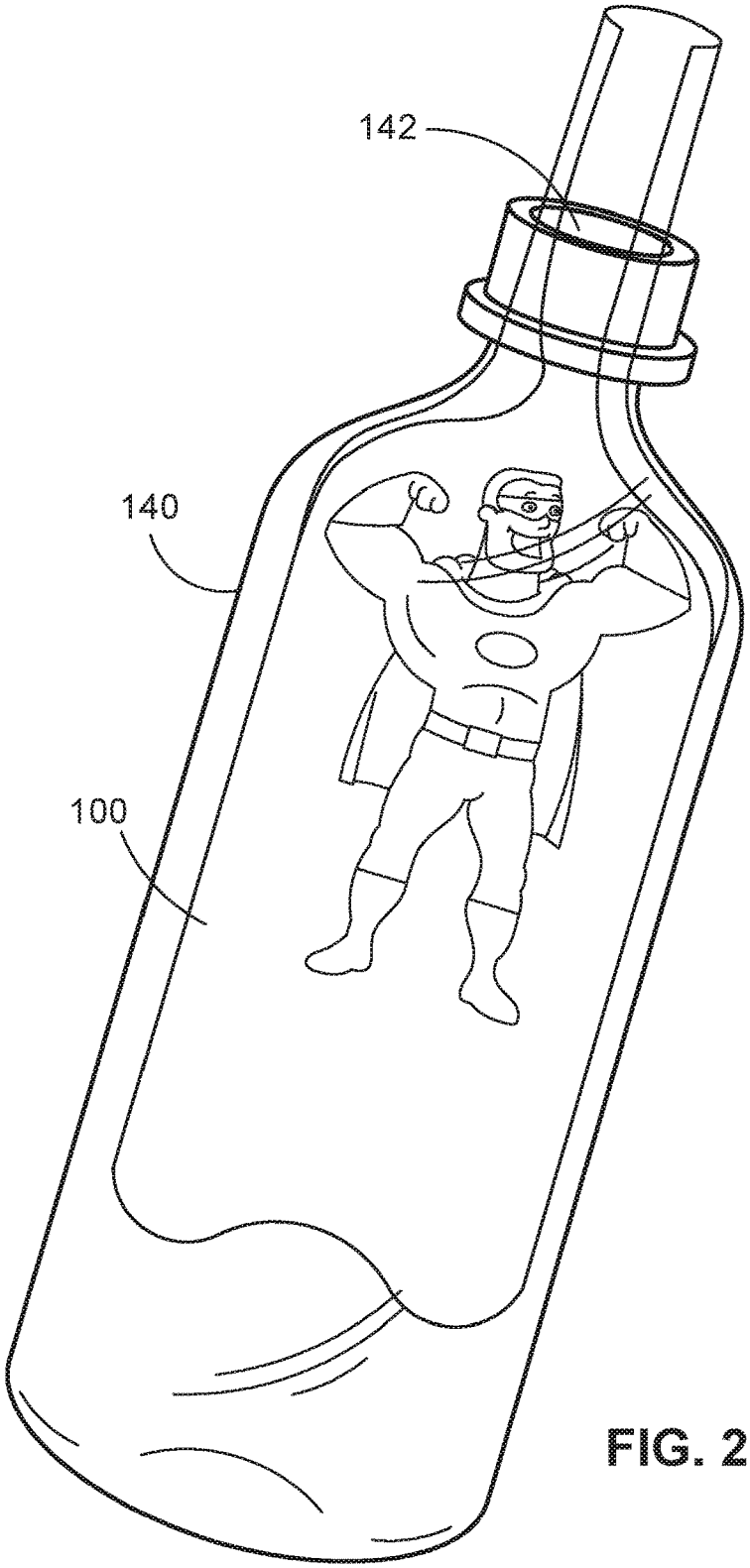
FIG. 2 is a perspective front view of a container including an insert according to an embodiment of the present invention, showing the insert partially removed from the container.
Figure 3:
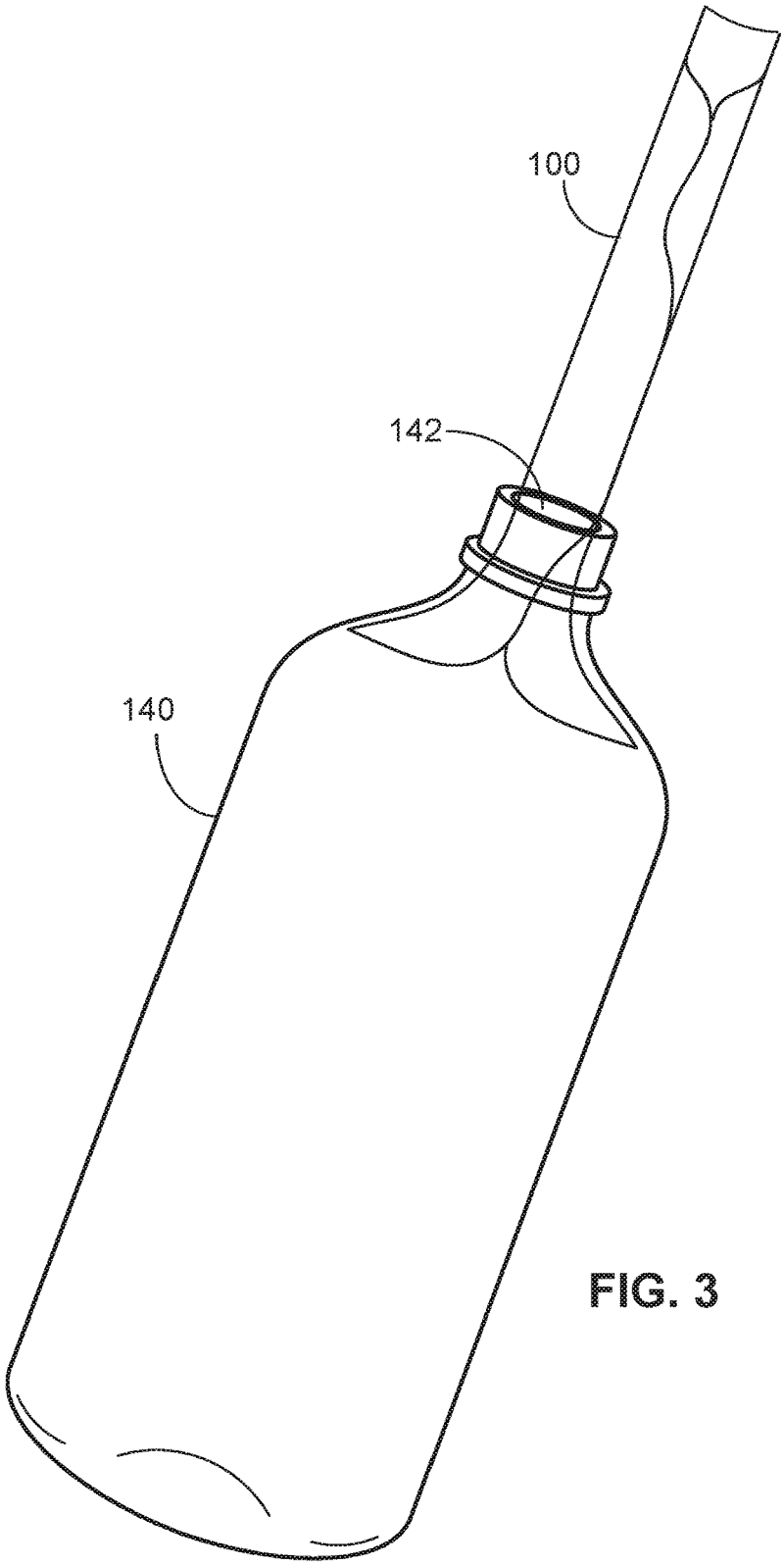
FIG. 3 is a perspective front view of a container including an insert according to an embodiment of the present invention, showing the insert partially removed from the container.

With reference to FIGS. 2 and 3, insert or foil 100 is shown in a partially deformed state partially removed from a container 140 through mouth 142. The foil may be curled, rolled and less preferably, folded, creased or otherwise deformed such that its width may be introduced and/or removed into or out of container 140 through mouth 142.

In use, with a generally cylindrical bottle having a mouth with an opening smaller than the diameter of the body of the bottle, the foil or insert is introduced to the bottle through the mouth of the bottle. As described above, the flexible foil is curled or rolled parallel to its vertical axis and introduced into the mouth of the bottle. After the foil is fully introduced and is no longer confined by the mouth of the bottle (or, alternately, after the foil is fully introduced except for a protrusion or tab at the first end extending through and/or over the mouth of the bottle), the resiliency of the foil allows it to flex back to its original, generally planar shape. The foil preferably has a width slightly less than the interior diameter of the bottle such that it can move within the bottle, but is held generally upright within the bottle by the inside walls of the bottle. The indentation at the bottom of the foil, allows the foil to rest securely on the inside bottom surface of the bottle. The protrusion at the upper end of the foil protrudes into the mouth of the bottle and helps to maintain the vertical orientation of the foil within the bottle.

Figure 8:
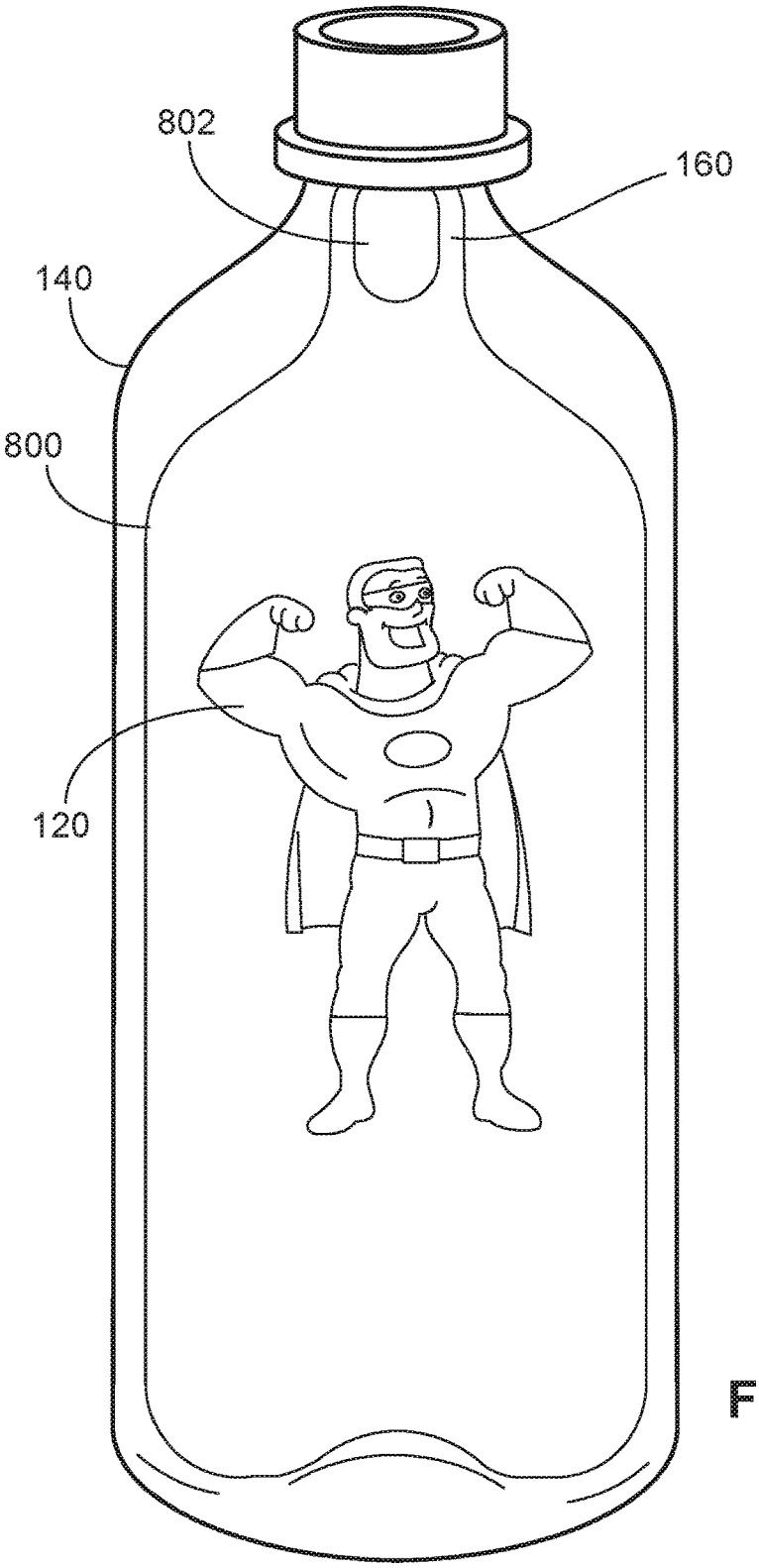
FIG. 8 is a perspective front view of a container including an insert according to an embodiment of the present invention, showing an insert within the container having a ring or grip for removal of the insert from the container.

The extent or reach of the protrusion can be selected as desired to make the insert more or less easy to remove the foil from the bottle. Thus, to make it difficult to remove the foil, the protrusion may extend only slightly into the mouth of the bottle, making it hard to reach from outside the mouth of the bottle. Alternatively, the protrusion may extend up beyond the upper surface of the mouth and fold over the outside surface of the mouth. In this way, the protrusion may be grasped and used to pull the foil from the bottle. In another embodiment, (as shown in FIG. 8) the protrusion may include an aperture and extend up into the mouth sufficiently to permit a user to grasp the aperture with, for example a finger, and pull the foil from the bottle.

In an embodiment, the geometry of the protrusion can be configured so as not to interfere with or be damaged by a filling nozzle entering the bottle neck of the container on a filling line. For example, an upper portion of the protrusion may be provided with a horizontal crease to allow the upper portion to be tilted towards the sidewall of the bottle neck of the container, thereby providing an unobstructed neck for the filling nozzle.

Figure 13:
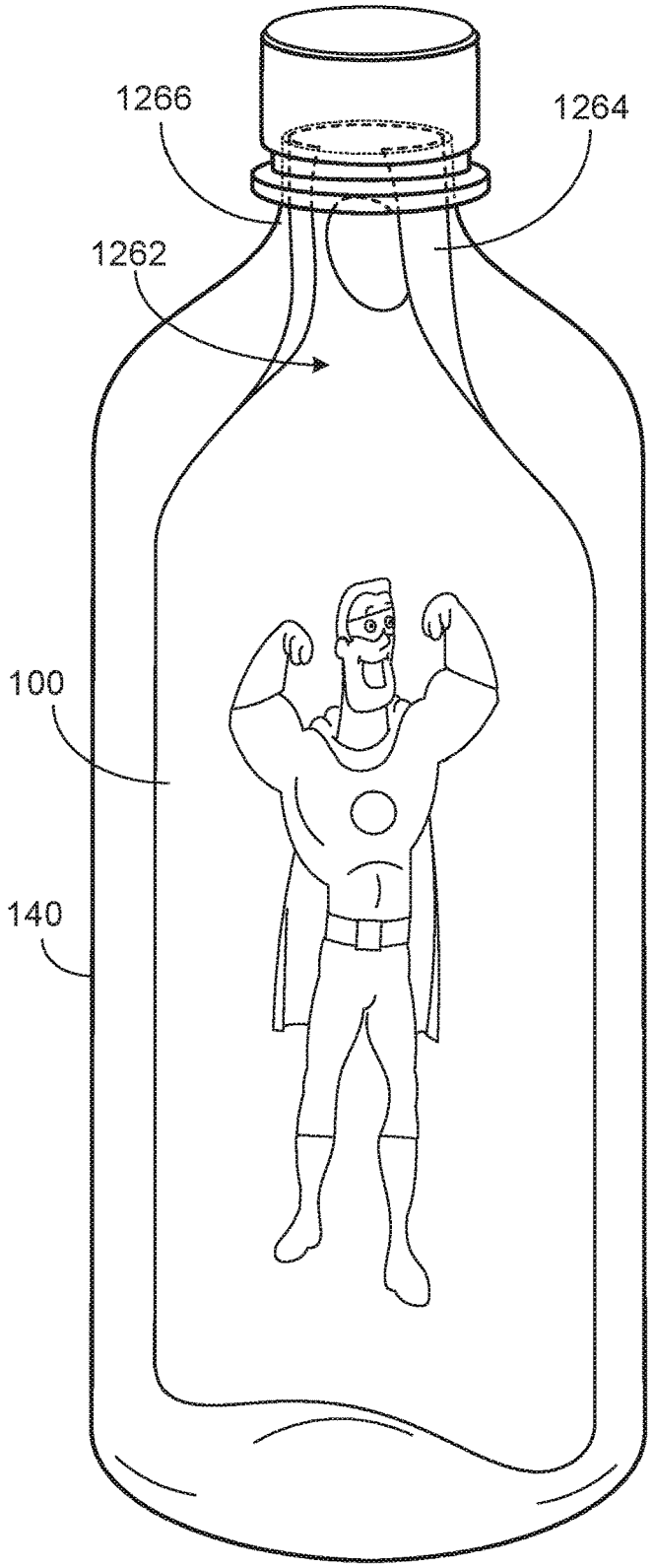
FIG. 13 is a perspective front view of a container including an insert according to an embodiment of the present invention, with a protrusion that does not interfere with the opening of the mouth and neck of the container.

With reference to FIG. 13, in an embodiment, the geometry of protrusion 1262 can be configured by providing an upper portion 1264 of the protrusion that is wider than the diameter of the neck 1266 of the container 140, such that upon insertion into the container, the upper portion of the resilient foil 100 springs or snaps into position along the inner wall of the neck, generally conforming the protrusion to lay along the inner surface of the neck, thereby providing an unobstructed or substantially unobstructed neck for a filling nozzle.

If desired to make it easier to remove the foil from the bottle, the foil may be provided with a shoulder between the side wall of the foil and the protrusion at the upper end of the foil. The shoulder provides a smooth transition from the protrusion and the side wall and makes it easier to pull the foil from the bottle. Alternatively, to make it more difficult to remove the foil, the foil can be provided with no shoulder, such that there is no smooth transition from the protrusion and the side wall of the foil.

Ideally, the protrusion should not extend upwardly and/or occupy space within the interior of the mouth of the bottle to such an extent that it interferes with the intended use of the container, e.g. pouring a liquid from the container or drinking directly from the container.

Figure 4A:
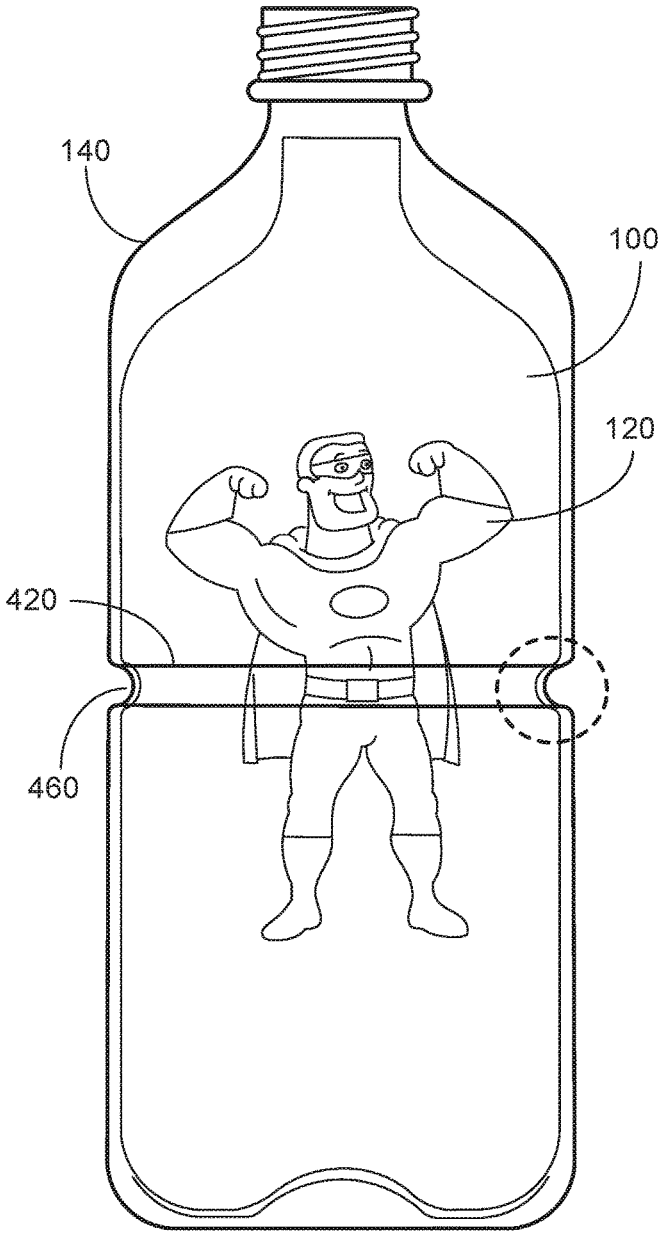
FIG. 4A is a front view of a container including an insert according to an embodiment of the present invention, showing an indentation in the side of the container and insert.
Figure 4B:
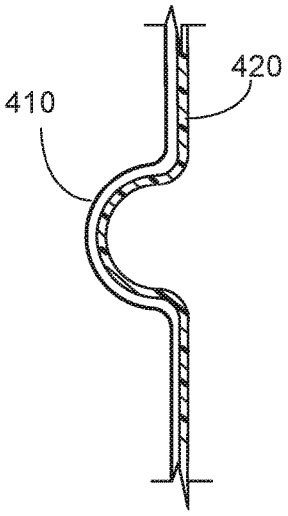
FIG. 4B is an enlarged view of a portion of FIG. 4A.

With reference to FIGS. 4A and 4B, foil 100 including a graphic 120 with an indentation 420 between the first end and the second end is shown. Foil 100 is placed within a container 140 having an indentation 460 about some or all of its circumference. Foil 100 includes a corresponding indentation 420 such that indentation in foil 100 accommodates surface indentation 460 in the container 140. A foil having one or more protrusions or indentations between the first end and the second end may be placed within a container with surface protrusion(s) or indentation(s) capable of accommodating the one or more protrusions or indentations in the foil. With the embodiment of FIG. 4, the foil having an indentation can snap into the corresponding indentation, providing stability for the foil in the container.

Figure 5C:
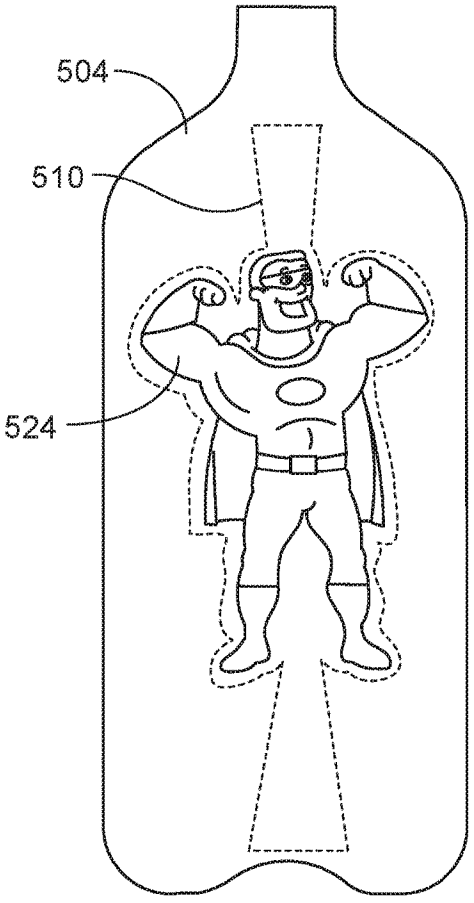
FIGS. 5A, 5B and 5C are schematic views of inserts with perforations according to an embodiment of the present invention.
Figure 5B:
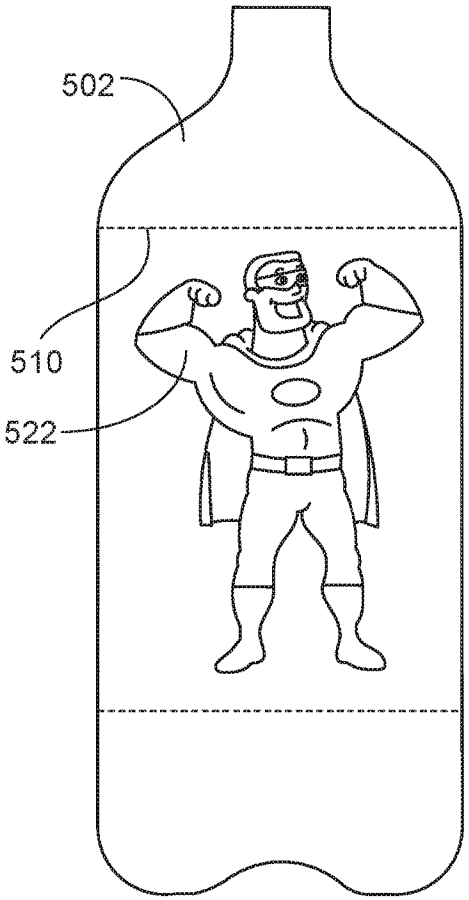
Figure 5A:
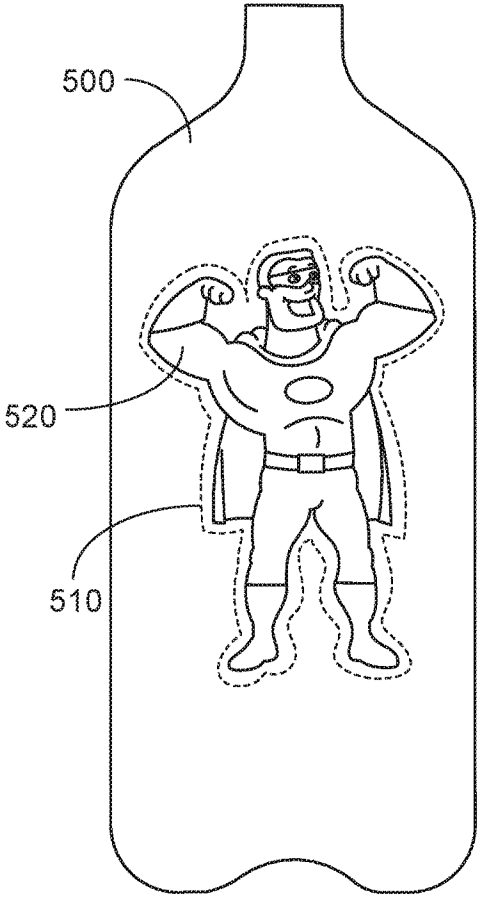

FIGS. 5A, 5B and 5C depict several foils 500, 502, and 504 each including a graphic 520, 522, and 524, respectively. Each graphic is detachable from the remainder of the foil by perforations 510. In the embodiment of FIG. 5A, the perforations generally follow the outline of the graphic. After the graphic is detached from the foil by separation at perforations 510, the user is provided with both the detached graphic 520 and the remaining foil 500 with an opening representing the outline of the detached graphic. This foil may be used as an alternative to graphics. For example, foil 500 may serve as template for sketching an outline of the detached graphic. In FIG. 5B, the perforations are perpendicular to the vertical axis of the foil. The foil may include a graphic reversibly or irreversibly detachable (e.g., along a perforated line) from the foil. For example, the portion of the foil comprising the graphic may be reversibly or irreversibly detached from the remainder of the foil. Examples of suitable graphics are known in the art, and may include, e.g., action figures, motivational phrases, photographs, promotional material, illustrations, drawings, etchings, sketches, holograms, cartoons, charts, tables, quotes, and/or other images. The perforations in the foil should be provided such that the stress on the foil during removal from the bottle is insufficient to prematurely detach the graphic from the foil before the foil is removed from the bottle. The perforations in the foil should also be of sufficient strength and durability that the graphic is not detached from the foil during filling, storage, transport or other use of the container.

Figure 6:
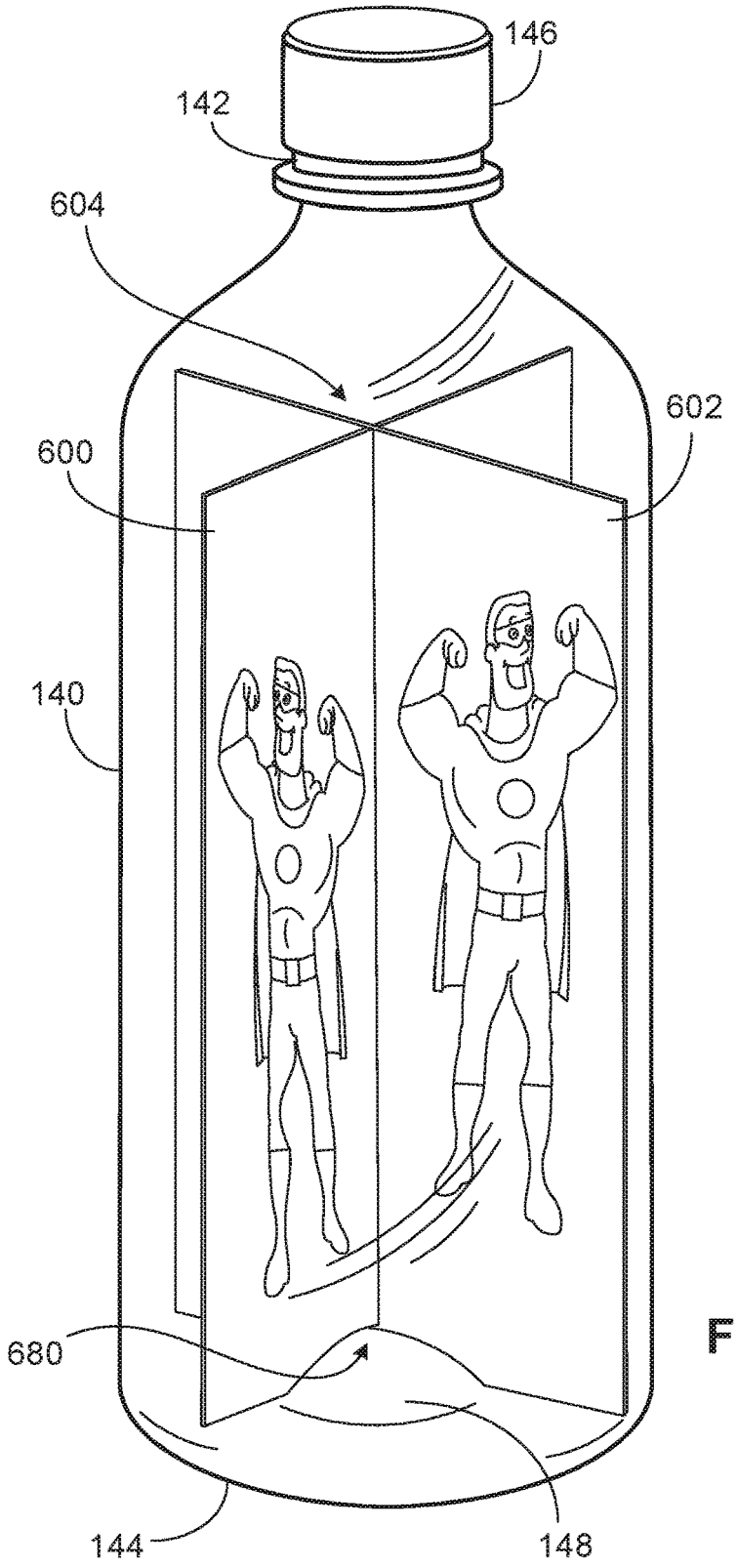
FIG. 6 is a perspective front view of a container including a two part insert according to an embodiment of the present invention.

FIG. 6 shows two foils 600 and 602 combined into a single self-supporting insert 604, placed within container 140 having mouth 142, bottom 144, cap 146, and an indentation in the bottom 148. The two foils are joined at a perpendicular angle at their respective centerlines. Insert 604 includes indentation 680 capable of accommodating the indentation (or push-up) in the bottom of container 148. The two foils of the self-supporting insert may be joined by including vertical slits partially extending through each foil and interlocking the foils through the slits. Alternatively, each foil may be folded along its length and joined to the other foil at the fold line, by gluing, welding, heat seal, etc. Each foil of the insert may include no graphics or one or more graphics. The number and/or content of graphics on each foil may be identical or different. Other self-supporting foils may be provided in a variety of shapes, such as a foil having for example, a triangular, square or zig-zag cross-section.

Figure 7:
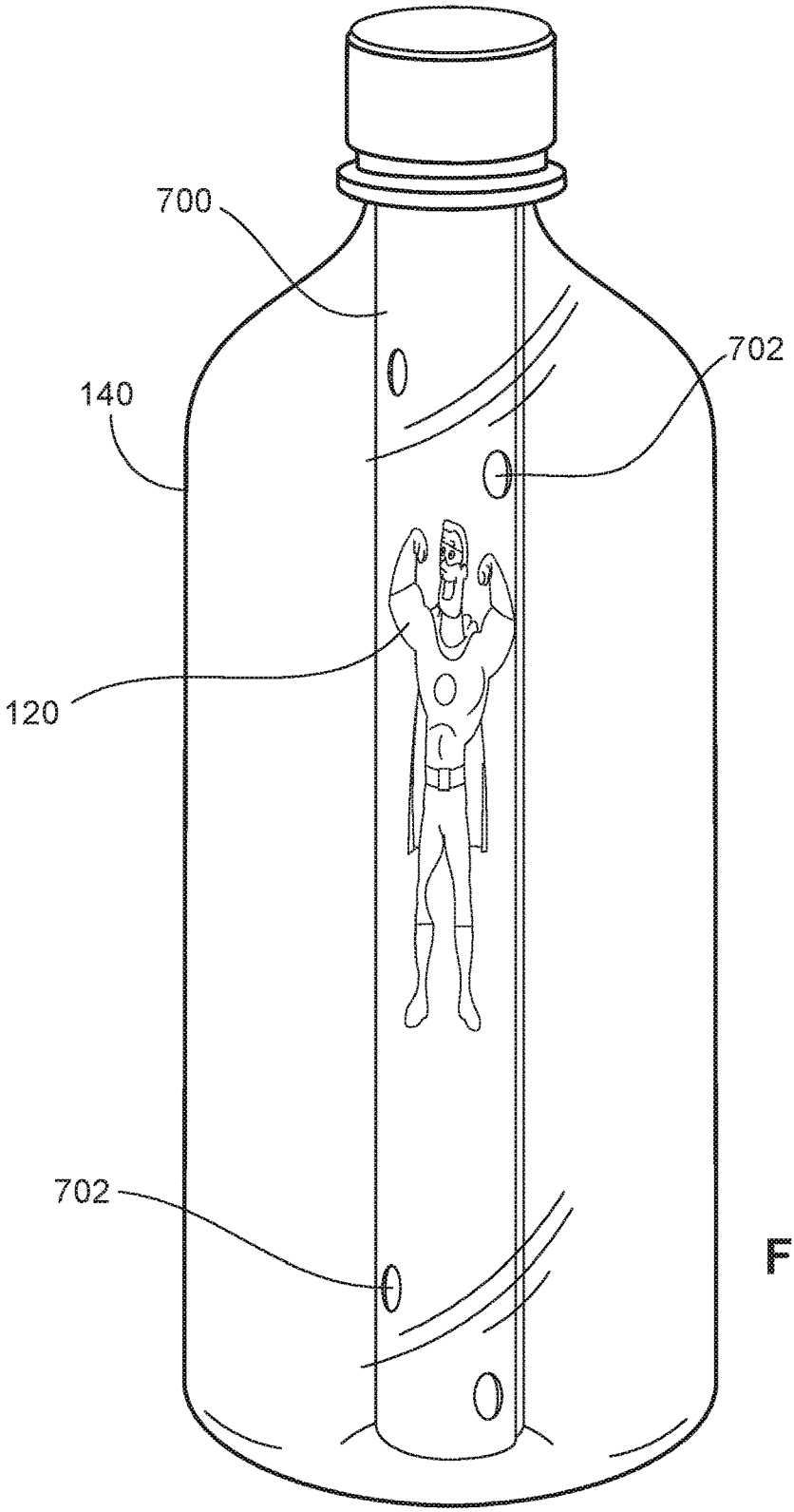
FIG. 7 is a perspective front view of a container including an insert according to an embodiment of the present invention, showing a tubular insert within the container.

The embodiment of FIG. 7 includes a foil 700 having a graphic 120 placed within a container 140. The foil 700 is generally cylindrical in shape and has a diameter less than that of the inside diameter of the mouth of the container. The circumference at the lower end of the foil fits about the indentation at the bottom of the container. The foil extends from the bottom of the container to at least a portion of the mouth of the container. The foil includes one or more apertures 702. In use, the apertures permit liquid in the container to be removed through the mouth without being blocked by the cylindrical foil. If desired, the foil is easily removable from the bottle as its diameter is less than that of the inside diameter of the mouth of the bottle. To prevent the foil from exiting the container prematurely, the foil and inside surface of the mouth of the bottle may be provided with corresponding indentations to snap-fit the cylindrical foil into position, causing it to resist easy removal from the container.

The embodiment of FIG. 8 includes a foil 800 including a protrusion extending towards or within the mouth of the container and including aperture 802 within the protrusion. Aperture 802 creates a ring or grip for a user to grasp the protrusion and pull the foil from the container.

Figure 9A:
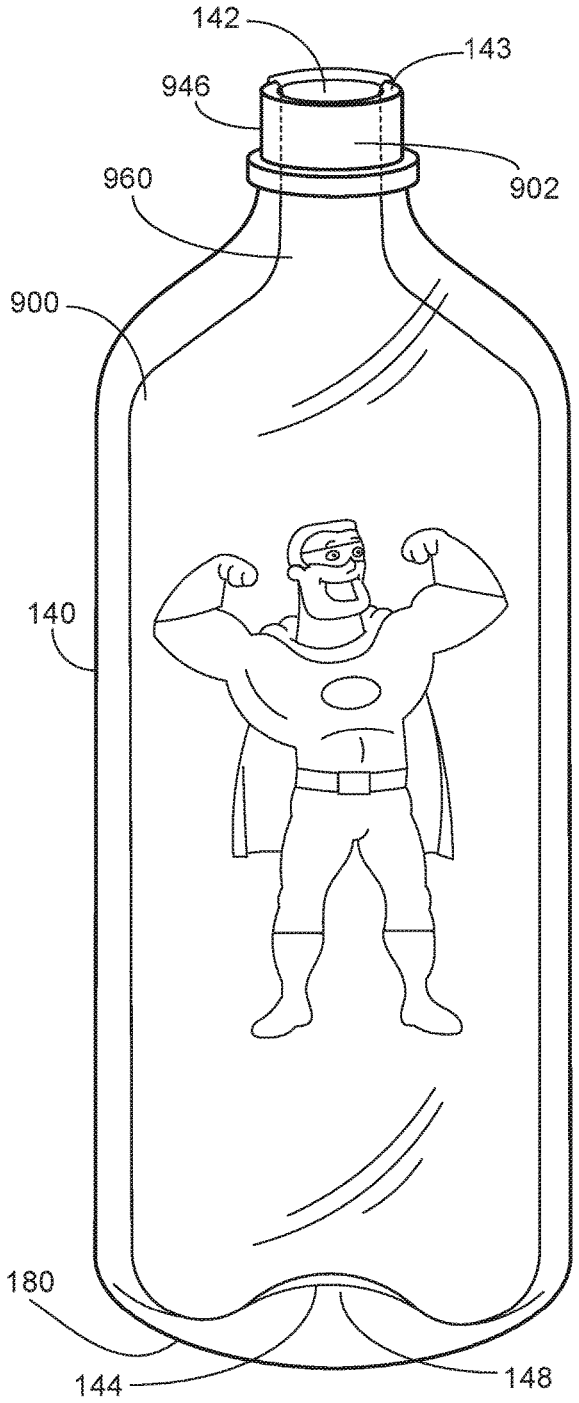
FIG. 9A is a perspective front view of a container including an insert according to an embodiment of the present invention, showing an insert within the container and a tab extending over the mouth of the container.
Figure 9B:
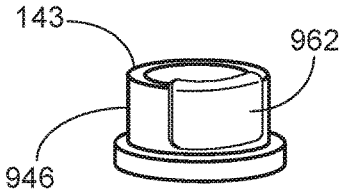
FIGS. 9B-9C show enlarged views of the container mouth and insert tab.
Figure 9C:
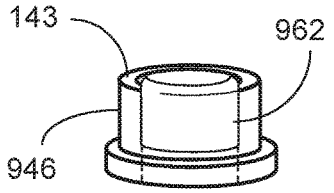

The embodiment of FIG. 9 includes a foil 900 placed within a container 140 having a mouth 142, a bottom 144, a cap mount 946, and an indentation in the bottom 148. The foil 900 includes protrusion 962 at a first end 960 and an indentation at a second end 180. The first end 960 is positioned within the mouth of the container 142, and extends vertically above the upper surface 143 of mouth 142. In an embodiment, protrusion 962 folds over the upper surface 143 of mouth 142 of container 140.

Figure 10A:
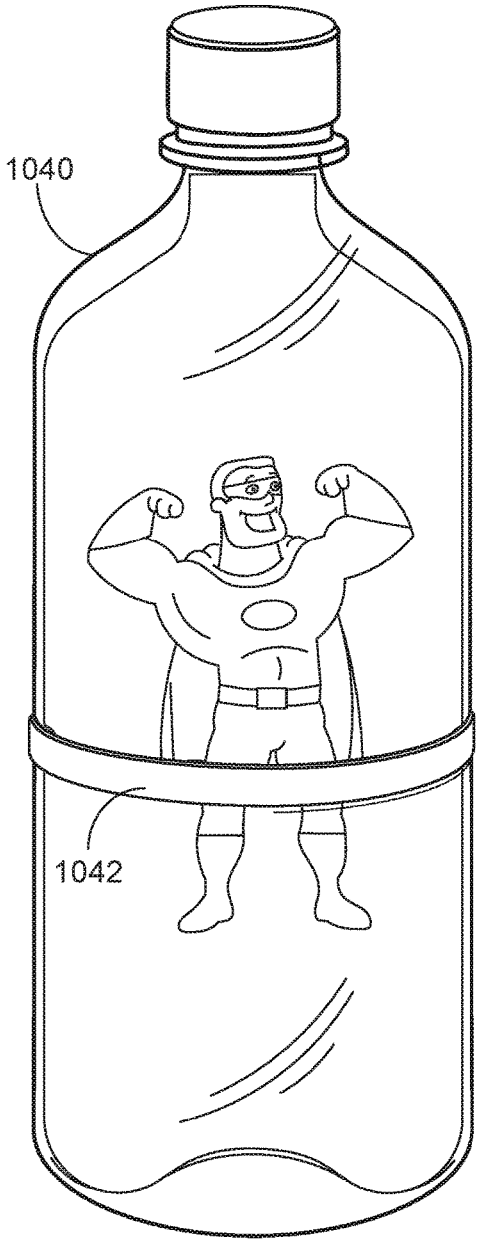
FIG. 10A is a perspective front view of a container including an insert according to an embodiment of the present invention, and a removable band surrounding the exterior of the container.
Figure 10B:
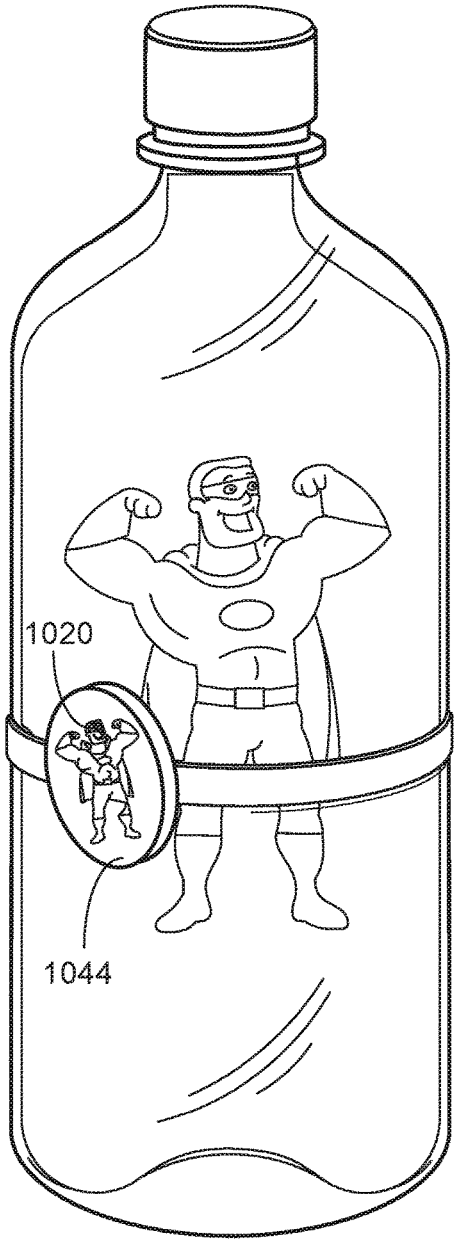
FIG. 10B is a perspective front view of a container including an insert according to an embodiment of the present invention, and a removable band with a button, surrounding the exterior of the container.

The embodiment of FIGS. 10A and 10B includes a foil placed within a container 1040 and also having a removable band 1042, optionally with a button 1044. The button 1044 includes a graphic 1020. In an embodiment the band fits within an indentation in the circumference of the container as shown for example, in FIG. 4.

Figure 11:
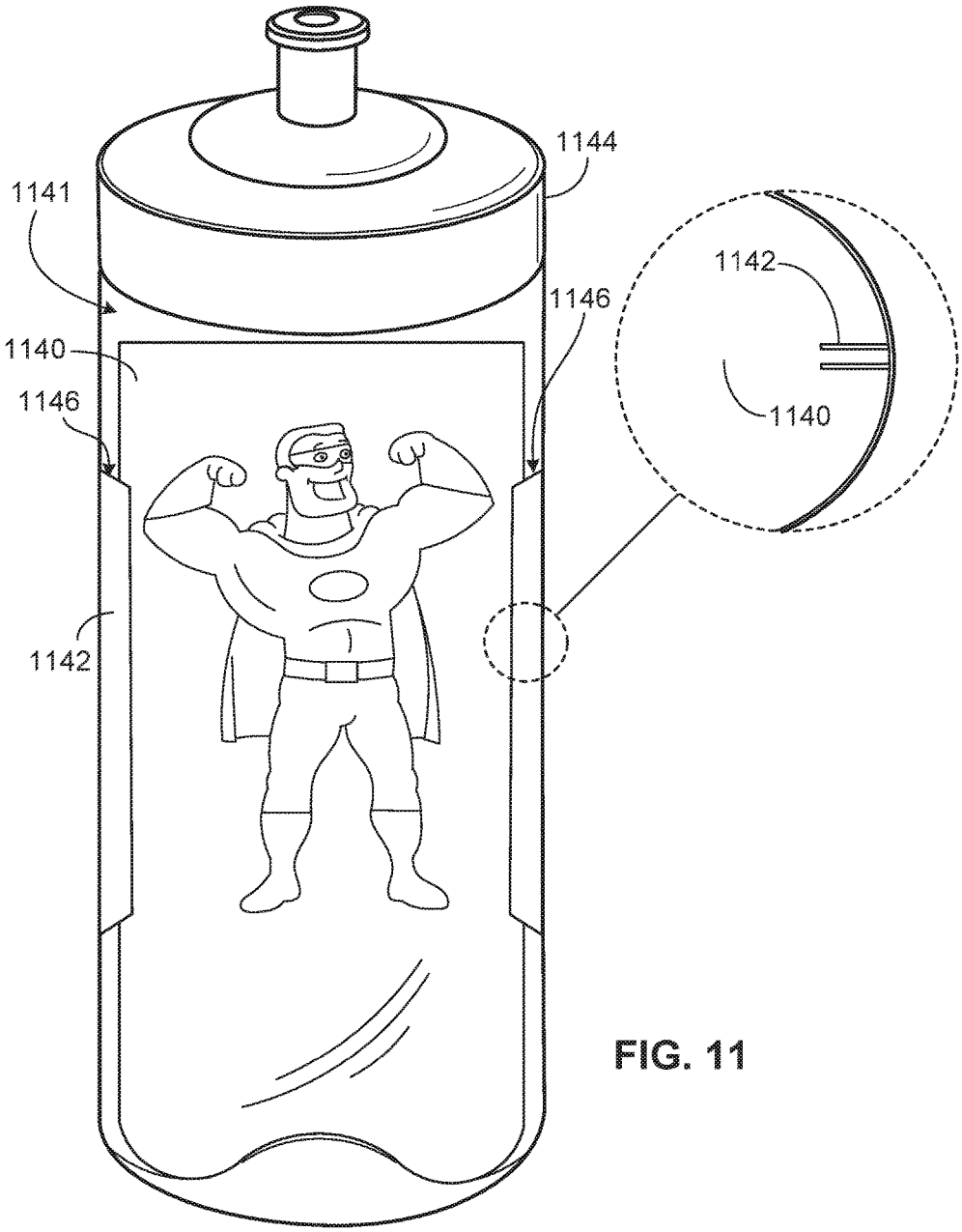
FIG. 11 is a perspective front view of a container including an insert according to an embodiment of the present invention, and slides, securing the foil.
Figure 12A:
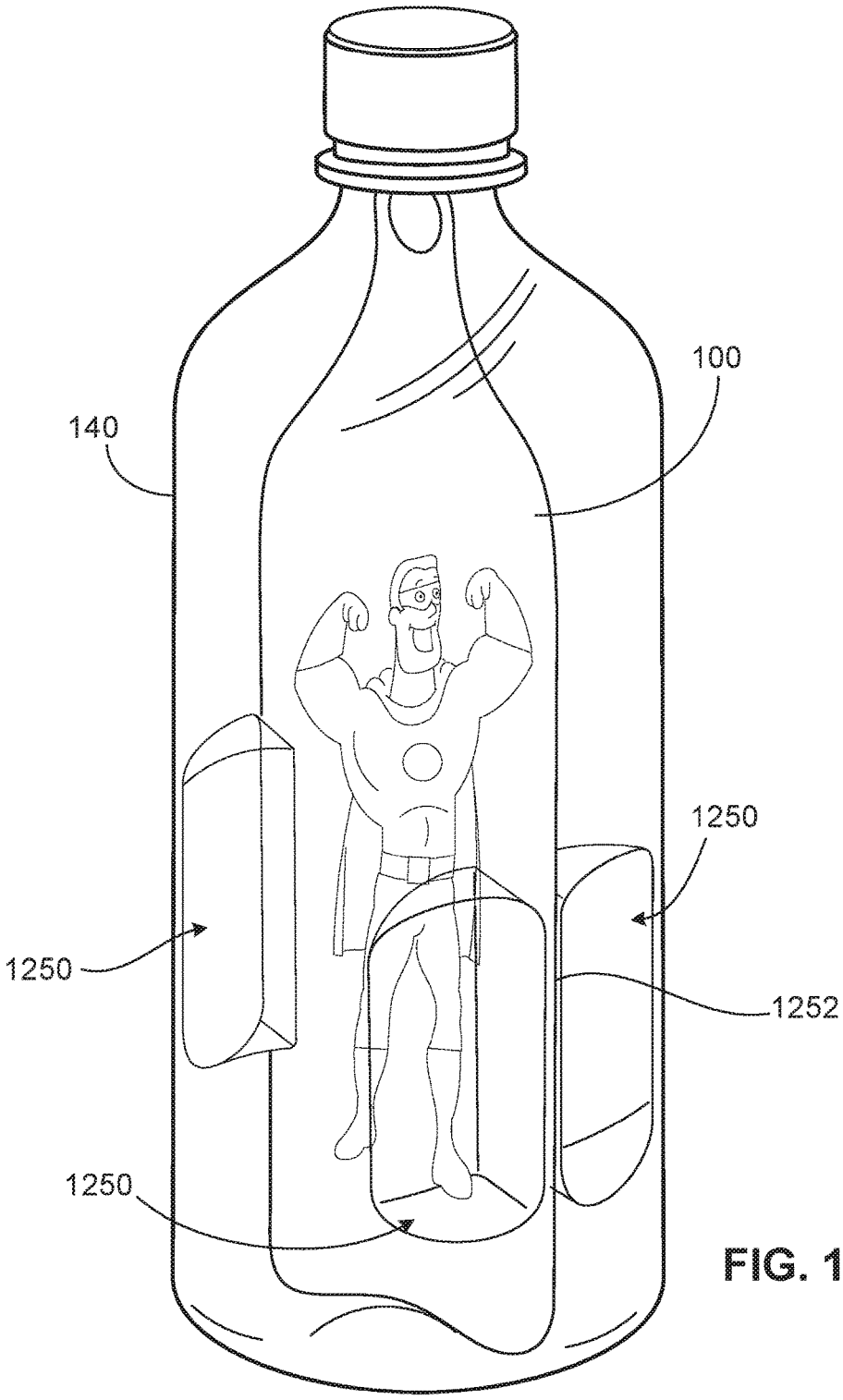
FIG. 12 is a perspective front view (12A), a front view (12B) and a side view (12C) of a container including an insert according to an embodiment of the present invention, and indentations in the container wall, securing the foil.
Figure 12B:
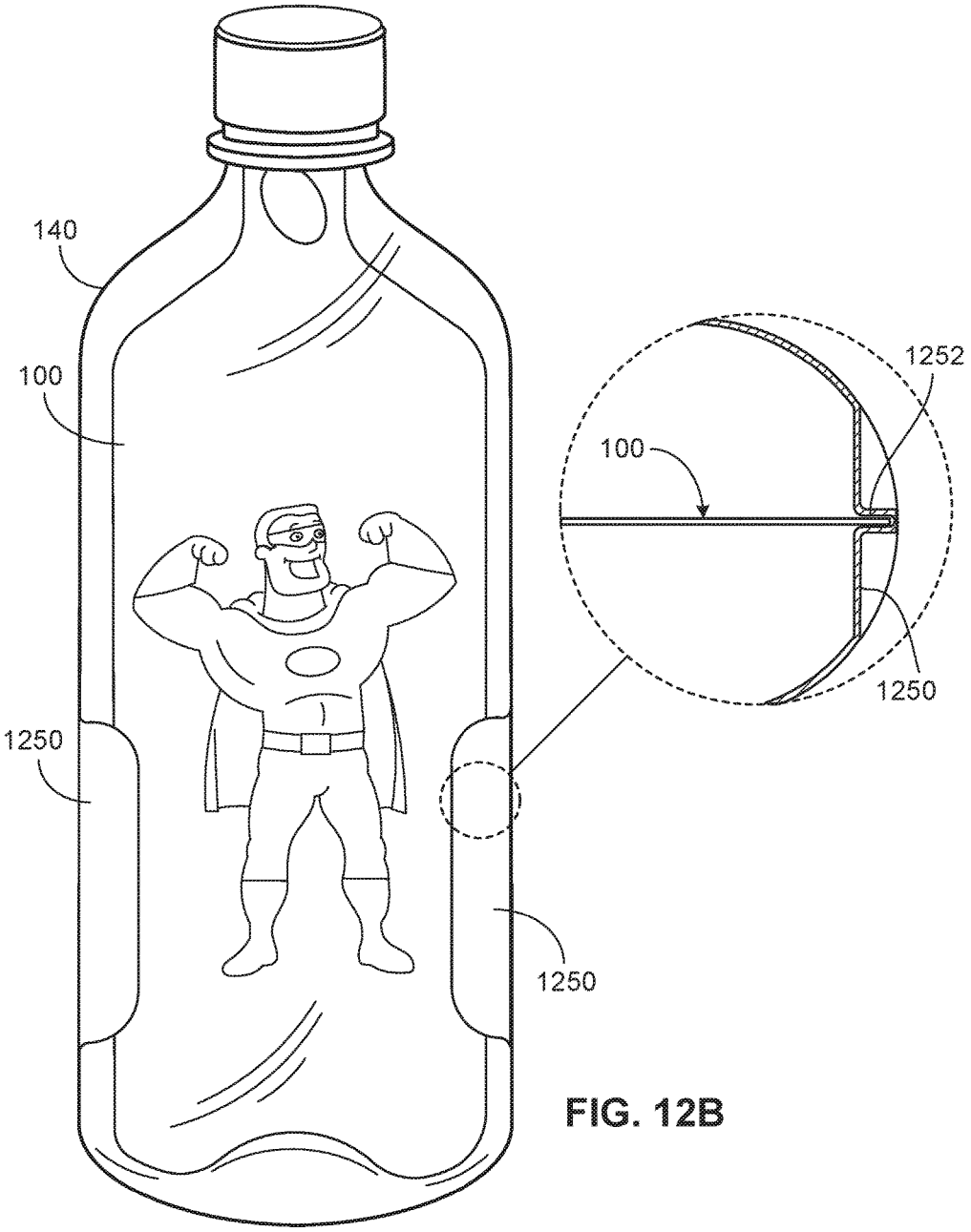
Figure 12C:
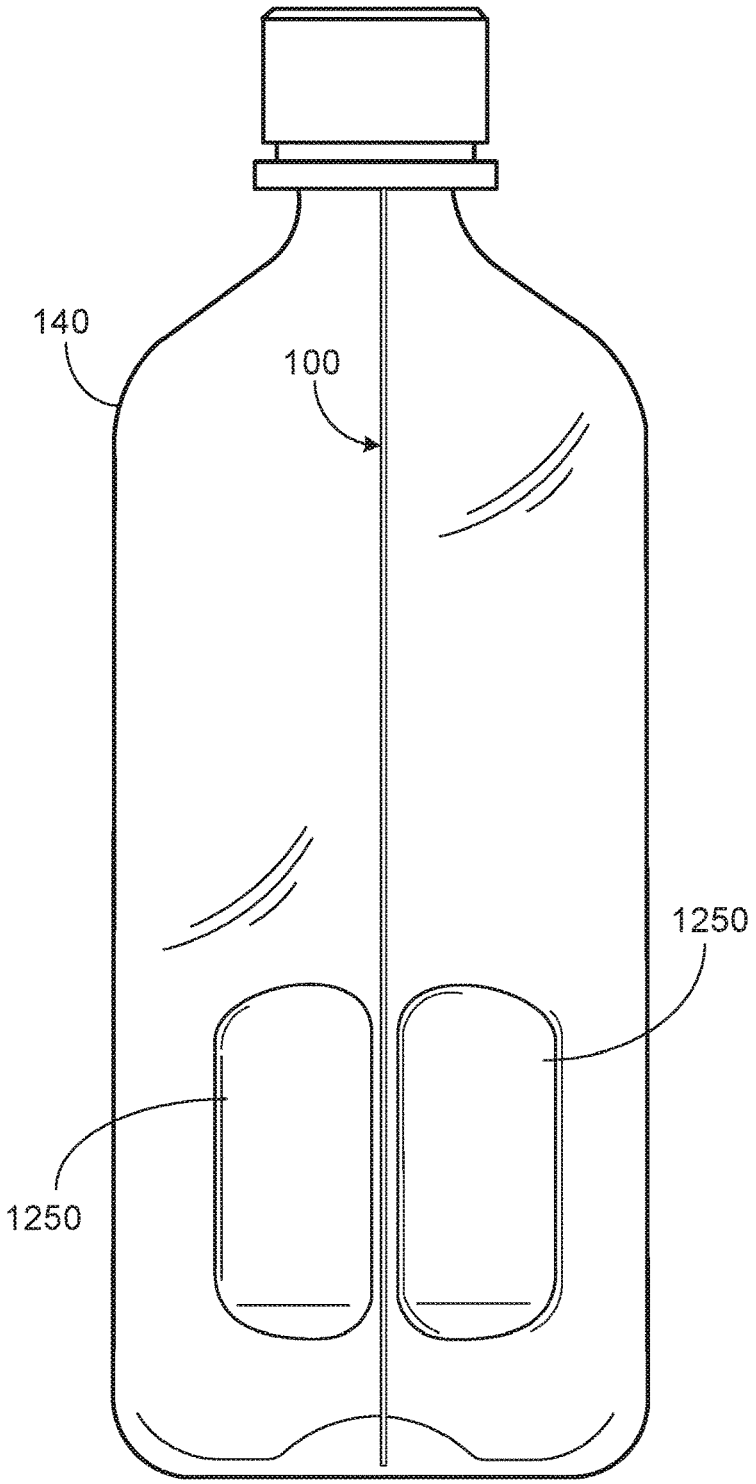

The embodiment of FIG. 11 includes a foil placed within a container 1141 having a wide mouth with a removable threaded cap 1144 and also having slides 1142 forming a channel along the interior wall of the container. Two opposing pairs of slides are provided. The slides may be provided for a portion of the vertical extent of the wall of the container. The upper end 1146 of slide 1142 may be beveled or chamfered. Slides 1142 may be molded into the wall of the container or affixed by other means such as glue or heat sealing. The embodiment of FIGS. 12A, 12B and 12C shows an embodiment similar to that of FIG. 11 but slides 1142 have been replaced with a pair of indentations 1250 formed in the container wall, forming a slide 1252 between the pair of indentations. In an embodiment, the bottom interior wall of the container may be provided with a channel, protrusion, detent, ridge or other physical barrier (not shown) to rotational movement of the foil inserted into the container.

Foil 1140 fits within the container by inserting it into the container with cap 1144 removed. The foil 1140 is secured in part by, slides 1142. In use, the foil is introduced to the container through the slides. The foil preferably has a thickness less than the width of the channel formed by the slides, and a width slightly less than the distance between the pairs of opposing slides, and is held generally upright within the bottle by the slides and/or by inside walls of the bottle.

The foil of the present invention may function as a label and/or as a collectible/novelty item or toy (e.g., a bookmark, (playing) card, game (piece), decal, flying object, floating object, coupon, ticket, pass, decorative/display piece, paperweight, etc.), and/or a tool (e.g., magnifying glass, etc.). The foil may have more than one function: it may function as a label when placed within a container, and as a collectible/novelty item or toy when removed from the container by a consumer. A graphic detached from a foil may function as a separate collectible item or toy (e.g., a motivational phrase or action figure display piece, or a collectible card, such as a baseball card).

The foil may be manufactured using one or more of a variety of flexible materials known in the art. Such materials include, e.g., plastics including polyethylene terephthalate (PET/PETE), high-density polyethylene (HDPE), polyvinyl chloride (PVC), low-density polyethylene (LDPE), polypropylene (PP), polystyrene (PS), polycarbonate (PC), acrylic (polymethyl methacrylate (PMMA)), nylon, polylactic acid or polylactide (PLA), bio-plastic, and polyester/copolyester (e.g., Eastman Tritan™). Such materials may be free of bisphenol A (BPA) (i.e., BPA-free) and/or other bisphenols (e.g., bisphenol S (BPS)). The foil should be manufactured using one or more materials such that the foil is sufficiently flexible so as to be reversibly deformed and placed into or removed from the container through the mouth (e.g., rolled up into a roll of diameter less than a diameter of the mouth of the container), yet stiff enough to automatically return to its original size and shape when not actively being deformed (e.g., after being placed into the container through the mouth). At the same time, it is desirable that the foil be made of a plastic material that will not break when torn or subjected to manual shear forces by the user. Use of such a material minimizes the possibility of a child, for example, breaking the foil into pieces that could create a choking hazard. An example of a suitable plastic material is PET. The foil may include a laminate of two or more layers of the same or different materials and may envelop a graphic made of the same or different material.

The foil may have a thickness between 0.01 mm and 4.0 mm, preferably between 0.1 mm and 1.5 mm. For example, the foil may have a thickness of 0.5 mm. The foil material(s) should be compatible with the container and contents of the container, and should not degrade, deform, dissolve, leach into or scalp from any liquid contained within the container. Further, the foil material(s) and printed graphics should be approved for use in contact with food and beverages.

The container and the foil may each be fully opaque, fully transparent, and/or semi-transparent or translucent. The container and the foil may each have any combination of fully opaque, fully transparent, and/or semi-transparent or translucent portions. For example, one or more portions of the foil may have an average transparency of at least 10%, at least 20%, at least 30%, at least 40%, at least 50%, at least 60%, at least 70%, at least 80%, at least 90%, at least 95%, or at least 99%. In an embodiment, a generally transparent removable foil is provided with translucent graphics, for example. After removal, the foil may be subjected to a backlight source, permitting the projection of the graphics, for example onto a wall.

Containers for liquids are generally known in the art, and include, e.g., disposable (single-use) or reusable, bottles, cans, canisters, coolers, cups, dispensers, jars, jugs, glasses mugs, pots, tanks, or tankards. A container may have, e.g., a disposable or reusable cap (including, e.g., a sports cap), cork, film, foil, lid, spigot, stopper, valve, or other dispensing tool or device covering the mouth. Suitable materials for containers are generally known in the art, and include, e.g., aluminum, paper, plastic, and glass. Containers may have any combination of fully opaque, fully transparent, and/or semi-transparent or translucent surfaces. For example, one or more surfaces of a container may have an average transparency of at least 10%, at least 20%, at least 30%, at least 40%, at least 50%, at least 60%, at least 70%, at least 80%, at least 90%, at least 95%, or at least 99%. Suitable liquids and mixtures for packaging within a container are generally known in the art, and include, e.g., one or more beverages (e.g., beer, coffee, electrolyte solutions (including, e.g., sports drinks), juices, sodas, soft drinks, teas, water, and wines), foods (e.g., cereals, oatmeal, soups), condiments or sauces (e.g., gravy, ketchup, mustard sauce, soy sauce, vinegar), deodorants (e.g., perfumes), nutritional supplements (e.g., vitamin E), creams, liniments, solutions, pastes, sprays, aerosols, gels, lotions, ointments, oils, suspensions, and cleaning solutions or detergents (e.g., conditioners, shampoos, soaps).

The container and the foil should each be manufactured using one or more materials such that the container and the foil (including indicia, if any) are resistant to degradation by suitable liquids for packaging within the container.

The container and/or the foil may be manufactured using one or more materials such that the container and/or the foil possess a refractive index essentially the same as (e.g., identical to) the refractive index of one or more liquids placed within (or capable of being placed within) the container. A container and foil each possessing a refractive index essentially the same as the refractive index of a liquid placed within the container may achieve a visual effect wherein the foil (except for (if applicable) indicia on the foil) appears to disappear from view.

In an embodiment, a container may be provided with a liquid containing dissolved gases (such as air, containing nitrogen and oxygen). Over time the gases may come out of solution and form small bubbles on the surfaces of the container and foil. Such bubbles can interfere with the desired visual effect of the foil. To minimize the generation and collection of such small bubbles, the surfaces of the container and/or foil may be altered to reduce surface tension. For example, anti-static additives or hydrophilic coatings may be provided on foil and container surfaces or mixed into the foil material prior to polymerization. Alternatively, the surface of the foil may be treated with plasma treatment or UV light treatment.

In an embodiment, a container and foil according to the present invention may be packaged in a multi-pack carton, arranged to increase the visual effect provided by the foil insert. This can be accomplished, for example, by increasing the visual contrast to have the visual appearance of the foil stand out from the container.

While the invention has been described in conjunction with the detailed description thereof, the foregoing description is intended to illustrate and not limit the scope of the invention, which is defined by the scope of the appended claims. Other aspects, advantages, and modifications are within the scope of the following claims.

All patent applications, patents, and other publications cited herein are incorporated by reference in their entireties.

What is claimed is:

1. An apparatus, comprising:

a container and a content display foil, the container having a mouth, a bottom and a wall;

the foil having a body portion with a first end and a second end, the foil having a protrusion at the first end, wherein the foil is self-supporting when placed in the container with the first end positioned at the mouth of the container and the second end positioned at the bottom of the container, the foil being sufficiently flexible so as to be reversibly deformed, wherein the deformed foil may be placed into or removed from the container through the mouth and wherein the mouth receives a cap providing a liquid seal.

2. The apparatus of claim 1, wherein the second end of the foil includes an indentation, and the bottom of the container includes an inward protrusion and the indentation at the second end of the foil is capable of accommodating the protrusion at the bottom of the container such that the second end does not interfere with the protrusion at the bottom of the container.

3. The apparatus of claim 1, wherein the foil includes a graphic and perforations to detach said graphic from the foil.

4. The apparatus of claim 3, wherein the graphic is applied to the surface of the foil by a method selected from the group consisting of printing, embossing, engraving and embedding, or combinations thereof.

5. The apparatus of claim 1, wherein the protrusion at the first end of the foil includes an aperture.

6. The apparatus of claim 1, wherein said foil includes a sloping shoulder extending from said body portion to said protrusion at the first end of the foil.

7. The apparatus of claim 1 wherein said foil is translucent or transparent.

8. The apparatus of claim 1 wherein said foil comprises a member of the group consisting of PET/PETE, HDPE, PVC, LDPE, PP, PS, PC, PLA, PMMA, nylon, bio-plastic and polyester/copolyester.

9. The apparatus of claim 1 wherein the foil is a laminate of two or more layers of the same or different material.

10. The apparatus of claim 9 wherein a graphic is provided within the laminate.

11. The apparatus of claim 1, wherein the container is a beverage container.

12. The apparatus of claim 1, wherein the cap is a screw-on cap.

13. The apparatus of claim 1, wherein the cap includes a valve for dispensing fluid from the container.

14. The apparatus of claim 1, wherein the protrusion at the first end extends upwardly beyond the mouth of the container and is foldable over the outer surface of the mouth.

15. The apparatus of claim 1, wherein the body portion of the foil includes at least one indentation along an outer edge and the outer surface of said container wall includes a complementary indentation, such that the indentation of the container wall may be retained within the indentation of the outer edge of the foil.

16. The apparatus of claim 1, wherein the wall of the container further comprises a pair of vertically oriented slides on each of opposite sides of the internal wall of the container, forming a pair of opposing channels; and the foil being generally rectangular and having vertical side edges, having a width less than the internal diameter of the container and a thickness less than the width of the channel, such that the side edges of the foil may be slidably engaged with the pair of channels upon introduction of the foil through the mouth of the container.

* * * * *